US005347291A

United States Patent [19]

Moore

[11] Patent Number: 5,347,291

[45] Date of Patent: Sep. 13, 1994

[54] CAPACITIVE-TYPE, ELECTRICALLY SHORT, BROADBAND ANTENNA AND COUPLING SYSTEMS

[76] Inventor: Richard L. Moore, 4102 Beacon Pl., Oceanside, Calif. 92056

[21] Appl. No.: 82,915

[22] Filed: Jun. 29, 1993

Related U.S. Application Data

[63] Continuation of Ser. No. 802,564, Dec. 5, 1991, abandoned.

[51] Int. Cl.[5] ..... H01Q 9/00; H01Q 1/24

[52] U.S. Cl. ..... 343/749; 343/908; 343/702

[58] Field of Search ..... 343/749, 908, 792, 795, 343/745, 789, 790, 752, 702, 841; H01Q 1/24, 9/00

[56] References Cited

U.S. PATENT DOCUMENTS

| | | | |
|---|---|---|---|
| 1,783,025 | 11/1930 | Meissner | 343/749 |
| 2,359,620 | 10/1944 | Carter | 250/33 |
| 3,829,863 | 8/1974 | Lipsky | 343/773 |
| 4,675,691 | 6/1987 | Moore | 343/908 |

FOREIGN PATENT DOCUMENTS

| | | | |
|---|---|---|---|
| 391077 | 4/1933 | United Kingdom | 343/745 |
| 1457173 | 12/1976 | United Kingdom | 343/700 MS |

OTHER PUBLICATIONS

J. D. Kraus, "Antennas", 1988, pp. 711–714.

R. C. Hansen, "Fundamental Limitations in Antennas", *Proceedings of the IEEE,* vol. 69, No. 2, Feb. 1981, pp. 170–182.

H. A. Wheeler, "Fundamental Limitations of Small Antennas", *Proceedings of the I.R.E.,* vol. 35, No. 12, Dec. 1947, pp. 1479–1484.

S. Ramo et al., "Fields and Waves in Modern Radio", 1944, pp. 432 and 458–459.

*Primary Examiner*—Donald Hajec

*Assistant Examiner*—Hoanganh Le

*Attorney, Agent, or Firm*—Foley & Lardner

[57] ABSTRACT

An electrically short antenna for transmitting or receiving radiation has first and second electrode forming a capacitor radiator. The antenna is short in the sense that the gap distance between the electrodes and the dimension of the electrodes themselves sum to less than λ/4. An inductor has one end thereof coupled to one of the first and second electrodes via a first wire, and the other of the electrodes is connected to ground via a second wire. The antenna includes structure for inhibiting transmission or reception of electromagnetic energy of wavelength λ from first and second wires so that transmission or reception of electromagnetic energy primarily emanates from said electrode surfaces.

23 Claims, 2 Drawing Sheets

CAPACITIVE-TYPE, ELECTRICALLY SHORT, BROADBAND ANTENNA AND COUPLING SYSTEMS

This application is a continuation of application Ser. No. 07/802,564, filed Dec. 5, 1991, now abandoned.

BACKGROUND OF THE INVENTION

Field of the Invention

The present invention relates to an improved antenna for transmitting and receiving radiation, and more particularly to a simplified and highly efficient antenna having a physical length which is short relative to the wavelength of the radiation and which is broadband. It also relates to automotive and other mobile system use of a single short antenna which can be coupled (1) in one way as the transmitting-receiving antenna for a Citizens Band radio or (2) in another way as a electrically-short efficient antenna to receive signals on the bands from AM to and including FM.

In my previous patent U.S. Pat. No. 4,675,691, incorporated herein by reference, I described an arrangement of electrodes which showed how an electrically-short antenna can be constructed by using an electrostatic capacitor such a split-cylindrical capacitor, as the radiating member of a resonant circuit. In this patent, the conductors forming the capacitors are concave surfaces.

As described herein, a short length antenna is defined as one which has a length equal to or less than one quarter of a wavelength ($\lambda/4$) of its resonant frequency. Usually, such short antennas typically exhibited a high Q or a rather sharp tuning peak.

In the present invention, we describe how we have subsequently found the new forms of capacitors can be made to operate as broad-band, efficient antennas.

To understand the previous theoretical appraisals of these type of antennas we refer to the following references, incorporated herein by reference.

Kraus, John D., "Antennas" 2nd Ed., McGraw-Hill, N.Y., 1988, especially pp. 711–714.

Hansen, R. C., "Fundamental Limitations of Antennas," Proc. IEEE, 69, 170–182, February, 1981.

Wheeler, H. A., "Fundamental limitations of small antennas," Proc. IRE, vol 35 pp. 1479–1484, Dec. 1947.

Ramo, Simon, and J. R. Whinnery, "Fields and Waves in Modern Radio" John Wiley & Sons, Inc , New York, N.Y., 1944, pp 432 and 458–459.

Professor Kraus, widely recognized as one of the foremost authorities on antennas, devotes a section of his recent book to the properties of electrically-short antennas. He relies on the work of R. C. Hansen and Wheeler, to conclude that the radiation resistance decreases with increasing wavelength, and that therefore no electrically small, efficient antenna is possible. This result is understandable since the treatment of antenna radiation for short antenna structures have assumed that the radiation takes place by means of dipole radiation formed by wires connected to the antenna structures.

SUMMARY OF THE INVENTION

It is the object of the present invention to provide an antenna with broad bandwidth, which becomes more efficient as the wavelength of the radiation increases.

It is a further object of the present invention to demonstrate the coupling of the herein described antenna structures and those described in my prior patent U.S. Pat. No. 4,675,691, to an AM-FM radio set to receive both AM and FM signals. Because of the increase of radiation resistance with increasing wavelength for either antenna the use of a wide-band inductor in series with (either) one of them provides good signals at both AM and FM frequencies.

It is a further object of the present invention to provide an improved capability of receiving or transmitting vertically polarized radiation by virtue of the physical arrangements of the electrodes.

The capacitive-type antenna described herein are connected in series with an inductor by means of a non-radiating twisted pair of wires. Because of the geometry, these wires have a minimum of length in which they are open to free-space. This length is the distance from the shielding provided by the electrodes of the capacitors, to the shielding of the electrical circuit box. This length is too short to provide the source of radiation. Rather, the source of radiation (and reception) is from the electric fields between the electrodes of the capacitor plates of the capacitive-type antenna themselves, i.e., it is derived from the fluctuations of charge on the capacitor plates.

The invention may be characterized as an antenna for transmitting or receiving radiation having a wavelength $\lambda$. The invention comprises:

a first electrode forming a first surface of a capacitor radiator, a second electrode, spaced from the first electrode by a gap, and forming a second surface of the capacitor radiator, the sum of the gap dimension and the dimensions of the first and second electrodes not exceeding $\lambda/4$, an inductor having one end thereof coupled to one of the first and second electrodes, a wire connecting the one end of the inductor to the one of the first and second conductors, and an additional wire connecting the other of the electrodes to ground, and a structure for inhibiting transmission or reception of electromagnetic energy of wavelength $\lambda$ from the wire means and the additional wire means so that transmission or reception of electromagnetic energy primarily emanates from the electrode surfaces.

DETAILED DESCRIPTION OF THE PREFERRED EMBODIMENTS

Figure 1:
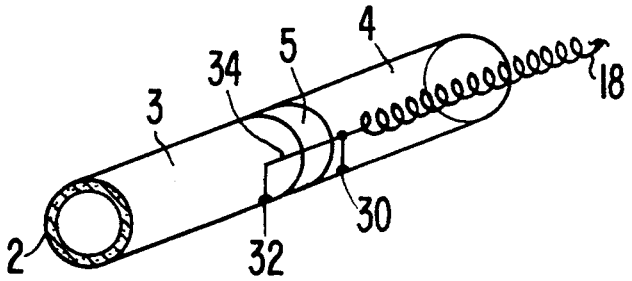
FIG. 1 is a perspective view of an antenna according to a first embodiment of the invention with annular electrodes mounted, with a gap between them, on a non-conducting annulus.

Reference will now be made to the various drawings to describe the presently preferred embodiments of the invention. FIG. 1 shows an antenna, 1, which is formed in a cylindrical shape composed of an annular tube 2 made of dielectric material. The diameter of the tube 2 may, for example be about 7/32", and its length may be on the order of 2". Mounted on the surface of tube 2 are two electrodes, 3 and 4 each composed of an annulus of a good conductor such as aluminum. The electrodes are separated by a gap, 5, of, for example ⅛" which prevents direct electrical conduction. Thus the assembly forms a capacitor.

A twisted wire pair 18 is shown entering the distal end of electrode 4. This twisted wire comes from the circuitry of FIGS. 4 or 5. The use of the twisted wire inhibits radiation of electromagnetic waves therefrom. One wire form the twisted pair is coupled to electrode 4 at point 30 and the other wire is fed across the gap 5 to contact electrode 3 at a point 32 as illustrated. Points 30 and 32 are positioned near the gap, although the electrodes 3 and 4 will themselves provide shielding for the wire 18 so that the point of contact with the electrodes need not necessarily be adjacent the gap as illustrated. For additional shielding, the portion 34 of the twisted pair 18 extending across the gap 5 may be spacedly covered with an electrically conductive shield to further inhibit radiation therefrom.

Figure 2:
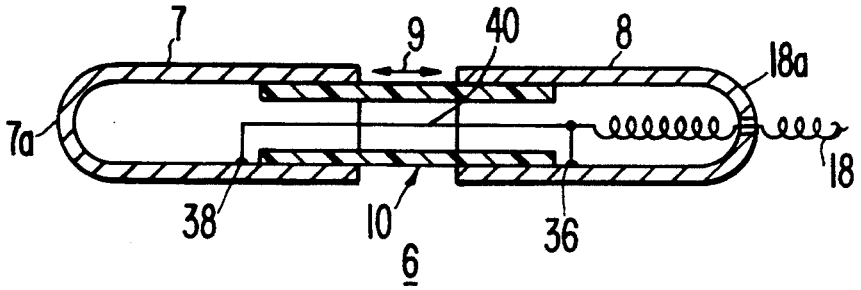
FIG. 2 is a cross-section view of a second embodiment of the invention with annular electrodes with one end being open, the other covered with a cap. These electrodes are mounted on a non-conducting annulus with a gap between the opposing open ends.

FIG. 2 is a cross-section view of a second embodiment of the invention. In FIG. 2, annular electrodes 7 and 8 each have one end thereof open and the other end covered with a cap 7*a* and 8*a* respectively. Electrodes 7 and 8 are mounted on a non-conducting annulus 10 and are spaced on the annulus 10 by a distance 9 so as to form a gap between the opposing open ends of the electrodes 7 and 8. The resulting structure likewise forms a capacitive structure. Again, twisted pair 18 may be fed into the antenna structure of FIG. 2 through an end electrode thereof. In this case, twisted pair 18 passes through an aperture in electrode 8 and connects to electrode 8 at point 36. Electrically conductive portion 40, extends across the gap 9 and connects to electrode 7 at point 38. Again, portion 40 may be electrically shielded. It is understood that in the twisted pairs used herein contain two conductors each insulated from one another and each twisted around the other so that each shields the other from radiating.

Figure 3:
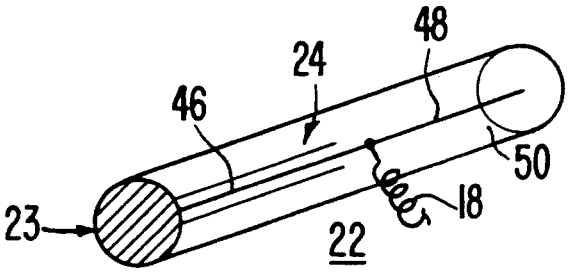
FIG. 3 is a perspective view of a third embodiment of the invention with plane electrodes mounted on the ends of a non-conducting annulus.

FIG. 3 illustrates a drum antenna structure fabricated in accordance with the principles of the invention. Electrically conductive drum surfaces or electrodes 23 (only one being shown) are positioned on the end of an insulating support member 24. The twisted pair 18 is fed through an aperture in the support member 24 and each wire thereof is separated and fed to the respective drum electrode 23. Portions 46 and 48 within the support member may be shielded as shown at 50 to prevent e.m. radiation. Shield 50 may be in the form of a conductive cylindrical sleeve spaced from the wire portions 46 and 48 as, for example, by means of an cylindrical insulator coextensive with the sleeve 50.

In FIGS. 1–3, it is understood that the antenna structures illustrated are dimensioned to be considered "short length" antenna which means that the length of the antenna is $\leqq \lambda/4$ at its resonant frequency. In the case of the antenna of FIG. 1, the length of the antenna refers to the overall length of electrodes 3 and 4 including the gap dimension 5. Likewise in the case of FIG. 2, the antenna length is taken as the combined length of electrodes 7 and 8 and the gap dimension. In the case of FIG. 3, since the thickness of the drum electrodes may be taken as negligible the length is taken to be the length of the insulating support member 24. In general, the gap dimension may be defined as the shortest straight line path between the spaced electrode surfaces and the antenna length defined as the sum of the gap dimension and the electrode length extending along this straight line path.

Figure 4:
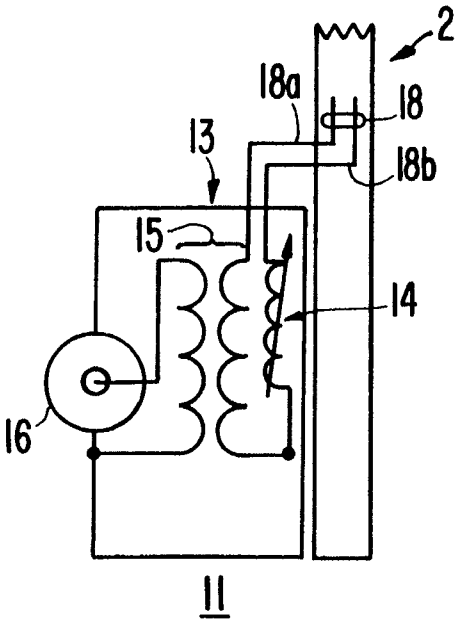
FIG. 4 is a diagram of an electrical coupling circuit which may be used for the antenna structures of FIGS. 1–3 when coupled to the input of a radio transmitter or receiver through a balun.

FIG. 4 illustrates the chassis and circuit design for the antenna of FIG. 1 in a CB antenna application. It is understood, however, that the same circuit may equally well be used for the antenna embodiments of FIGS. 2 and 3. In reference to FIG. 4, one end, of one of the twisted pair of wires, 18*a*, contained in the tube 2 of the dielectric material, is connected to the electrode 3. The other end of wire 18*a* is connected to one terminal of balun 15. The second wire 18*b* has one end thereof connected to the electrode 4, and its other end connected to one terminal of a mechanically tunable, resonating inductor, 14. The other terminal of the inductor 14, is connected to a terminal of the balun 15. Thus, the design of FIG. 4 connects an LC circuit (composed of inductor 14 and capacitive antenna 1) in series with the balun 15. Balun 15 may, for example, be a 300 Ohm to 300 Ohm standard balun. The measured radiation resistance of the antenna circuit was approximately 25 ohms at resonance of 28 MHz.

The other terminals of the balun 15, are connected in the usual fashion. One end to ground, the chassis 13, the other to the central terminal of the coaxial receptacle, 16 of a 50 ohm transmission line. The transmission line in turn was connected to a Radio-Shack CB, TRC 415, Catalogue number 21 1509A. Transmission and reception was successful on all channels.

AM-FM band radio receiver

Figure 5:
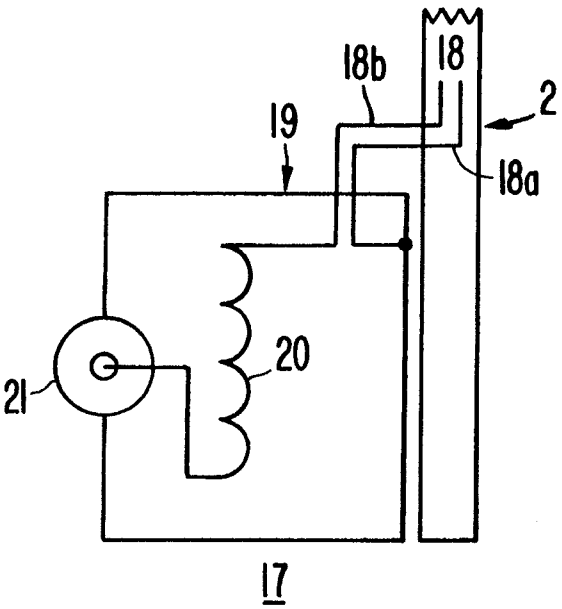
FIG. 5 is a diagram of an electrical coupling circuit which may be used with the antennas of FIG. 1–3 when coupled to the input of an automobile AM-FM radio receiver.

Using a Kraco, AM-FM-Cassette radio receiver, the antenna of FIG. 1 was mounted to a circuit box as shown in FIG. 5 for use in an AM-FM circuit arrangement. As seen in this figure, an LC circuit is connected in series with the coaxial line.

In reference to FIG. 5, one end, of one of the twisted pair of wires 18*a* is connected to the electrode, 3, while the other end is connected to the grounded chassis 19. Further, one end of the second wire 18*b* is connected to the electrode 4, with its other end connected directly to a terminal of a resonating inductor 20. The other terminal of the inductor 20, is connected directly to a central conductor of a coaxial receptacle 21 without coupling through a balun as in the embodiment of FIG. 4. The ground of the chassis forms the ground shield of the coaxial receptacle 21. Receptacle 21 thus forms connectors which are coupled to a receiver.

In place of twisted pairs of wires, separately and individually shielded wires may also be used. Alternately, the wires, or unshielded parts thereof may simply be made short enough so that the radiation emitted or received therefrom is relatively small as compared with that emitted/received from the electrodes which form the capacitive plates of the antenna structures of FIGS. 1–3. The primary requirement for the circuits of both FIGS. 4 and 5 is that the radiation emitted/-received by the wires connecting the circuits to the electrodes be minimized while the radiation emitted/- received from the capacitive electrode plates be maximized.

The radio was placed inside an automobile and connected it to the car battery through the cigarette lighter socket. The antenna chassis box, 19 with the antenna of FIG. 1 connected thereto was placed on the roof of the automobile and coupled to the receiver by a standard cable. Radio signals were heard throughout both the AM and FM bands demonstrating the wide-band nature of this antenna system.

A cylindrical split-curved plate antenna (such as illustrated in U.S. Pat. No. 4,675,691) was also mounted vertically in place of the antenna of FIG. 1 and this split-curved plate antenna demonstrated the same bandwidth as the antenna design of FIG. 1 herein.

Technical Data

The antenna radiation resistance was measured in the same manner as described in my prior U.S. Pat. No. 4,675,691, as shown therein in FIG. 2. The following tables set forth the results of the measurements.

TABLE 1

Radiation resistance in ohms as a function of frequency for antenna used in preferred embodiment of FIG. 1.

| FREQ (MHz) | RES (ohms) |
|---|---|
| 26.000 | 45.00 |
| 29.500 | 50.00 |
| 31.000 | 25.00 |
| 37.000 | 45.00 |
| 40.000 | 10.00 |
| 43.000 | 40.00 |
| 50.000 | 30.00 |
| 55.000 | 5.00 |
| 56.000 | 5.00 |
| 70.000 | .01 |
| 76.000 | 0.01 |
| 85.000 | 0.01 |
| 86.000 | 0.001 |

Table 2

Radiation resistance vs. frequency for "Drum" type antenna, of FIG. 3, with a diameter of 1".

| FREQ (MHz) | RES (ohms) | GAP (inches) |
|---|---|---|
| 31.000 | 100.00 | 1.600 |
| 68.000 | 55.00 | 1.600 |
| 105.000 | 50.00 | 1.600 |
| 21.000 | 50.00 | 0.500 |
| 26.500 | 50.00 | 0.500 |
| 42.000 | 23.00 | 0.500 |
| 58.000 | 25.00 | 0.500 |
| 60.000 | 25.00 | 0.500 |
| 62.000 | 25.00 | 0.500 |
| 62.500 | 19.99 | 0.500 |
| 70.000 | 25.00 | 0.500 |
| 75.000 | 20.00 | 0.500 |
| 82.000 | 23.99 | 0.500 |
| 82.000 | 2.00 | 0.500 |
| 101.000 | 1.00 | 0.500 |
| 110.000 | 1.00 | 0.500 |
| 28.000 | 60.00 | 0.250 |
| 34.000 | 25.00 | 0.250 |

TABLE 3

Radiation resistance in ohms for antenna of FIG. 2 with electrodes 2⅛" diameter, 2" long.

| FREQ (MHz) | RES (ohms) | GAP (inches) |
|---|---|---|
| 11.000 | 20.00 | 0.015 |
| 20.000 | 35.00 | 0.015 |
| 27.000 | 9.00 | 0.015 |

TABLE 3-continued

Radiation resistance in ohms for antenna of FIG. 2 with electrodes 2⅛" diameter, 2" long.

| FREQ (MHz) | RES (ohms) | GAP (inches) |
|---|---|---|
| 36.000 | −5.00 | 0.015 |
| 52.000 | −1.00 | 0.015 |
| 58.000 | 2.00 | 0.015 |
| 62.000 | −3.00 | 0.015 |
| 66.000 | −3.00 | 0.015 |
| 6.000 | 60.00 | 0.125 |
| 21.000 | 63.00 | 0.125 |
| 22.500 | 80.00 | 0.125 |
| 23.400 | 90.00 | 0.125 |
| 23.400 | 99.00 | 0.125 |
| 24.000 | 37.00 | 0.125 |
| 26.200 | 89.00 | 0.125 |
| 29.000 | 18.00 | 0.125 |
| 30.000 | 25.00 | 0.125 |
| 35.000 | 10.00 | 0.125 |
| 42.000 | 10.00 | 0.125 |
| 48.000 | 8.00 | 0.125 |
| 10.950 | 80.00 | 0.250 |
| 14.200 | 70.00 | 0.250 |
| 22.900 | 40.00 | 0.250 |
| 23.400 | 35.00 | 0.250 |
| 28.800 | 30.00 | 0.250 |
| 30.900 | 20.00 | 0.250 |
| 11.000 | 90.00 | 0.375 |
| 14.000 | 70.00 | 0.375 |
| 14.200 | 68.00 | 0.375 |
| 15.200 | 70.00 | 0.375 |
| 17.300 | 50.00 | 0.375 |
| 19.700 | 68.00 | 0.375 |
| 26.000 | 50.00 | 0.375 |
| 32.000 | 50.00 | 0.375 |
| 34.000 | 55.00 | 0.375 |
| 36.000 | 40.00 | 0.375 |
| 14.500 | 69.00 | 0.500 |
| 21.200 | 65.00 | 0.500 |
| 22.500 | 80.00 | 0.500 |
| 23.500 | 100.00 | 0.500 |
| 26.200 | 45.00 | 0.500 |
| 32.000 | 60.00 | 0.500 |

As may be seen from the above tables, in accordance with the principles of the invention, the radiation resistance of the antenna structures varies inversely with frequency. This is precisely the opposite relationship as exist in conventional dipole or whip antennas.

In general, the antenna includes some mechanism for inhibiting transmission or reception of electromagnetic energy of wavelength λ from the wires which connect the capacitive electrodes to the circuits illustrated in FIGS. 4 and 5. This mechanism may be the use of relatively short wires 18*a* and 18*b* which, because of their relatively short wires 18*a* and 18*b* which, because of their relatively short length, do not effectively radiate or receive electromagnetic radiation. In such a case, the short wires radiate very little, and the major contributor to the circuit radiation resistance would be the electrodes defining the capacitive plates. In another embodiment, the mechanism of inhibiting the transmission or reception of electromagnetic energy comprises the shielding of the first and second wires which is effective to minimize radiation and reception therefrom. Clearly, a combination of both short wires and shielding is also within the scope of the invention. Other mechanisms may also be apparent to those of skill in the art to minimize the radiation/reception of electromagnetic from the wires and maximize the energy radiated/received from the electrodes forming the capacitive plates of the antenna.

The invention has been described in terms of preferred embodiments of the invention. However, modifications and improvements of the invention will be apparent to persons of ordinary skill in the art and the invention is intended to cover all such modifications and improvements which fall within the scope of the appended claims.

What is claimed is:

1. An antenna for transmitting or receiving radiation having a wavelength λ comprising:

a first electrode forming a first surface of a capacitor radiator, a second electrode, spaced from said first electrode by a gap, and forming a second surface of said capacitor radiator, the sum of the gap dimension and the dimensions of said first and second electrodes not exceeding λ/4, an inductor having one end thereof coupled to one of said first and second electrodes, wire means for connecting said one end of said inductor to said one of said first and second electrodes, additional wire means for connecting the other of said electrodes to ground, and means for inhibiting transmission or reception of electromagnetic energy of wavelength λ from said wire means and said additional wire means so that transmission or reception of electromagnetic energy primarily emanates from said electrode surfaces.

2. An antenna as recited in claim 1 wherein said means for inhibiting comprises means for shielding said wire means.

3. An antenna as recited in claim 2, wherein said wire means comprises one of a twisted pair of wires and said shielding means comprises the other of said twisted pair of wires, said other of said twisted pair of wires also forming said additional wire means.

4. An antenna as recited in claim 1 wherein said means for inhibiting comprises said wire means and said additional wire means configured to be of a relatively small length so as to radiate only a relatively small amount of electromagnetic in relation to that of said electrodes.

5. An antenna as recited in claim 1 wherein said first and second electrodes are in the form of cylindrical surfaces having central axes of revolution coincident with one another.

6. An antenna as recited in claim 5, wherein said first and second electrodes form conducting surfaces of an insulating cylindrical support member.

7. An antenna as recited in claim 6, wherein each of said first and second electrodes have a closed cap region on one end thereof to enclose said insulating cylindrical support member.

8. An antenna as recited in claim 1, further comprising first and second connectors for connecting said antenna to a receiver, the other end of said inductor connected to one of said connectors and said addition wire means connected to the other of said connectors thereby providing a ground connection to said receiver.

9. An antenna as recited in claim 8, further comprising means for at least partially shielding said wire means and said additional wire means so as to minimize transmission or reception of electromagnetic energy of wavelength λ therefrom.

10. An antenna as recited in claim 1, wherein said first and second electrodes are in the form of planar surfaces, lying in planes parallel to one another.

11. An antenna as recited in claim 10, wherein said first and second electrodes are secured to ends of a cylindrical support member.

12. An antenna as recited in claim 10, wherein said wire means comprises one of a twisted pair of wires and said means for inhibiting comprises shielding means which includes the other of said twisted pair of wires, said other of said twisted pair of wires forming said additional wire means connecting the other of said first and second electrodes to ground.

13. An antenna as recited in claim 1, further comprising first and second connectors for connecting said antenna to a receiver, the other end of said inductor connected directly and without a balun to one of said connectors and said addition wire means connected to the other of said connectors thereby providing a ground connection to said receiver.

14. An antenna for transmitting or receiving radiation having a wavelength λ comprising:

a first electrode forming a first surface of a capacitor radiator, a second electrode, spaced from said first electrode by a gap, and forming a second surface of said capacitor radiator, the sum of the gap dimension and the dimensions of said first and second electrodes not exceeding λ/4, an inductor having one end thereof coupled to one of said first and second electrodes, wire means for connecting said one end of said inductor to said one of said first and second electrodes, additional wire means for connecting the other of said electrodes to ground, and means for at least partially shielding said wire means and said additional wire means so as to minimize transmission or reception of electromagnetic energy of wavelength λ therefrom so that transmission or reception of electromagnetic energy primarily emanates from said electrode surfaces.

15. An antenna for transmitting or receiving radiation having a wavelength λ comprising:

a first electrode forming a first surface of a capacitor radiator, a second electrode, spaced from said first electrode by a gap, and forming a second surface of said capacitor radiator, an antenna length not exceeding λ/4, where a gap dimension is defined as the shortest straight line path between the first and second electrode surfaces, and the antenna length is defined as the sum of the gap dimension and the first and second electrode dimensions extending along said straight line path, an inductor having one end thereof coupled to one of said first and second electrodes, wire means for connecting said one end of said inductor to said one of said first and second electrodes, additional wire means for connecting the other of said electrodes to ground, and means for inhibiting transmission or reception of electromagnetic energy of wavelength λ from said wire means and said additional wire means so that transmission or reception of electromagnetic energy primarily emanates from said electrode surfaces.

16. An antenna for transmitting or receiving radiation having a wavelength λ comprising:

a first electrode forming a first surface of a capacitor radiator, a second electrode, spaced from said first electrode by a gap, and forming a second surface of said capacitor radiator, the sum of the gap dimension and the dimensions of said first and second electrodes not exceeding $\lambda/4$, an inductor having one end thereof coupled to one of said first and second electrodes, wire means for connecting said one end of said inductor to said one of said first and second electrodes, additional wire means for connecting the other of said electrodes to ground, and said first and second electrodes forming cylindrical surfaces and having axes of revolution coincident with one another.

17. An antenna for transmitting or receiving radiation having a wavelength $\lambda$ comprising:

a first electrode forming a first surface of a capacitor radiator, a second electrode, spaced from said first electrode by a gap, and forming a second surface of said capacitor radiator, the sum of the gap dimension and the dimensions of said first and second electrodes not exceeding $\lambda/4$, an inductor having one end thereof coupled to one of said first and second electrodes, wire means for connecting said one end of said inductor to said one of said first and second electrodes, said other end of said inductor connected to at least one of a transmitter and receiving for transmitting and receiving said radiation respectively, additional wire means for connecting the other of said electrodes to ground, whereby said first and second electrodes and said inductor form a series connected LC circuit;

said first and second electrodes being substantially flat surfaces and arranged parallel to one another, and housing means for shielding said inductor.

18. An antenna as recited in claim 17, wherein said ground and said housing are electrically connected together.

19. An antenna as recited in claim 17, further comprising a balun connected between said other end of said inductor and said at least one of said transmitter and receiver.

20. An antenna for transmitting or receiving radiation having a wavelength $\lambda$ comprising:

a first electrode forming a first surface of a capacitor radiator, a second electrode, spaced from said first electrode by a gap, and forming a second surface of said capacitor radiator, the sum of the gap dimension and the dimensions of said first and second electrodes not exceeding $\lambda/4$, an inductor having one end thereof coupled to one of said first and second electrodes, wire means for connecting said one end of said inductor to said one of said first and second electrodes, additional wire means for connecting the other of said electrodes to ground, and wherein said first and second electrodes form conducting surfaces of an insulating cylindrical support member and wherein each of said first and second electrodes have a closed cap region on one end thereof to enclose said insulating cylindrical support member.

21. An antenna for transmitting or receiving radiation having a wavelength $\lambda$ comprising:

a first conductor having a side thereof non-concavely curved with respect to a plane;

a second conductor, disposed directly on an opposite side of said plane and having a side non-concavely curved with respect to said plane, said second conductor having a length substantially equal to the length of said first conductor, said first and second conductors being separated by a gap coincident with said plane to thereby define a capacitance;

an inductor coupled at one end thereof to at least one of said first and second conductors and coupled at the other end thereof to at least one of a transmitter and receiver, said inductor and first and second conductors forming a series connected LC resonance circuit;

wherein said first and second conductors have a length of approximately $\lambda/4$ or less at a resonant frequency of said LC resonant circuit; and wherein said antenna includes a housing enclosing said inductor.

22. An antenna as recited in claim 21, wherein said ground and said housing are electrically connected together.

23. An antenna as recited in claim 21, further comprising a balun connected between said other end of said inductor and said at least one of said transmitter and receiver.

* * * * *